US010328330B2

(12) United States Patent
Avgustin et al.

(10) Patent No.: US 10,328,330 B2
(45) Date of Patent: Jun. 25, 2019

(54) COLLAPSIBLE SKI

(71) Applicant: ELAN, d.o.o., Begunje na Gorenjskem (SI)

(72) Inventors: Vinko Avgustin, Zirovnica (SI); Andrej Hrovat, Radovljica (SI)

(73) Assignee: ELAN, d.o.o., Gorenjskem (SI)

( * ) Notice: Subject to any disclaimer, the term of this patent is extended or adjusted under 35 U.S.C. 154(b) by 0 days.

(21) Appl. No.: 16/068,844

(22) PCT Filed: Sep. 15, 2016

(86) PCT No.: PCT/SI2016/000022
§ 371 (c)(1),
(2) Date: Jul. 9, 2018

(87) PCT Pub. No.: WO2017/131590
PCT Pub. Date: Aug. 3, 2017

(65) Prior Publication Data

US 2019/0022513 A1 Jan. 24, 2019

(30) Foreign Application Priority Data

Jan. 27, 2016 (SI) ..... P-201600028

(51) Int. Cl.
*A63C 5/02* (2006.01)
*A63C 9/02* (2012.01)
*A63C 9/00* (2012.01)

(52) U.S. Cl.
CPC ..... *A63C 5/02* (2013.01); *A63C 9/003* (2013.01); *A63C 9/02* (2013.01); *A63C 2203/10* (2013.01); *A63C 2203/44* (2013.01)

(58) Field of Classification Search
CPC ..... A63C 5/02; A63C 9/02; A63C 2203/10
See application file for complete search history.

(56) References Cited

U.S. PATENT DOCUMENTS 2,260,057 A * 10/1941 Rydberg ..... A63C 5/02 280/603
2,289,459 A * 7/1942 Rydberg ..... A63C 5/02 280/603
3,689,093 A * 9/1972 Meland ..... A63C 5/02 280/603
4,405,150 A 9/1983 Esper
(Continued)

FOREIGN PATENT DOCUMENTS

CA 2758145 A1 * 9/2010 ..... A63C 5/02
CH 171068 A * 8/1934 ..... A63C 5/02
(Continued)

OTHER PUBLICATIONS

International Search Report issued in PCT/SI2016/000022; dated Jan. 24, 2017.

*Primary Examiner* — James A Shriver, II
*Assistant Examiner* — Steve Clemmons
(74) *Attorney, Agent, or Firm* — Studebaker & Brackett PC

(57) ABSTRACT

A collapsible ski, by which the front part and a rear part of the ski, when aligned, in such position fixed by a platform, which is by hinges interconnected with a bearing plate, which is attached onto a top surface of the front part of the ski and is rotatable around geometric axis, which extends perpendicularly with respect to the top surface of the ski.

5 Claims, 6 Drawing Sheets

(56) References Cited

U.S. PATENT DOCUMENTS

| | | | | | |
|---|---|---|---|---|---|
| 4,458,912 | A * | 7/1984 | Bertonneau | A63C 5/02 | 280/603 |
| 4,593,926 | A * | 6/1986 | Pergola | A63C 5/02 | 280/603 |
| 4,645,228 | A * | 2/1987 | Bertonneau | A63C 5/02 | 280/603 |
| 9,586,127 | B2 * | 3/2017 | Avgustin | A63C 9/003 | |
| 9,744,431 | B2 * | 8/2017 | Etallaz | A63C 5/02 | |
| 2009/0250906 | A1 * | 10/2009 | Ritter | A63C 5/02 | 280/623 |
| 2010/0102522 | A1 * | 4/2010 | Kloster | A63C 5/02 | 280/14.24 |
| 2012/0306171 | A1 * | 12/2012 | Shirion | A63C 5/02 | 280/11.15 |

FOREIGN PATENT DOCUMENTS

| | | | | | |
|---|---|---|---|---|---|
| DE | 2452728 | A1 * | 5/1976 | A63C 5/02 | |
| DE | 29516108 | U1 * | 12/1995 | A63C 5/02 | |
| EP | 2 856 898 | A1 | 4/2015 | | |
| FR | 837166 | A * | 2/1939 | A63C 5/02 | |
| GB | 2 501 742 | A | 11/2013 | | |
| JP | H04-026426 | A | 1/1992 | | |
| SI | 24358 | A | 11/2014 | | |
| WO | WO-8807882 | A1 * | 10/1988 | A63C 5/02 | |
| WO | WO-8905679 | A1 * | 6/1989 | A63C 5/02 | |
| WO | 01/97929 | A2 | 12/2001 | | |
| WO | 2014/189472 | A1 | 11/2014 | | |

* cited by examiner

COLLAPSIBLE SKI

The invention belongs to the field of sport articles, namely to skis, and specifically refers to a collapsible ski.

The purpose of the invention is to create a ski, which consists of parts to be simply assembled in situ without any tools, which should on the one hand simplify storage and transporting and on the other hand simplify also the technology of manufacturing of each particular part in comparison with the manufacturing of a classic one-part ski, wherein all components of the ski have to be permanently interconnected both during use and also in a collapsed position, and none of the constituent parts protrudes beyond the length of both parts of such a ski, and wherein the concept of the ski offers each average user all benefits of classic skis, in particular a uniformly bending curve and a corresponding distribution of loads along the ski edges.

A collapsible ski is disclosed in SI 24358 A and WO 2014189472, to which the applicant in this application wishes to rely by reference, wherein such a ski in its assembled i.e. functional state comprises a front area with a tip, which is smoothly bent away from the ground, a rear area at least approximately flat or smoothly bent away from the ground, as well as a central area, which is provided for mounting of a ski binding which consists of a front part and a rear part and is mounted on the upper surface facing away from the ground. While in use, an opposite sliding surface faces the ground and is furnished with ski edges which extend at least along a majority of the ski length. Such a ski consists of a front part and a rear part, which are interconnected and can be pivoted around a geometric axis which extends parallel to said sliding surface. Moreover, said parts, in their aligned position, can be optionally immobilized by means of a platform, on which the front part and a rear part of a ski binding, which is provided for attachment of a ski shoe, are mounted. Moreover, when said front part and said rear part are aligned and immobilized by means of a platform, said platform is rotatable around the geometric axis which extends throughout the pivoting area between said parts and is perpendicular with respect to said sliding surface. When the ski is assembled and ready to use, said platform with the mounted parts of the ski binding is adjusted to cooperate with each of said parts of the ski. When the platform is removed, said parts can be pivoted relative to each other, so that the ski can be stored in a disassembled state, e.g. in a rucksack, however, the platform is separated from said part, so that during use e.g. in alpinism, or during military activities, it can be easily lost or the like.

Having regard to said simplified technology of manufacturing of each particular part, the purpose of the invention is also providing a possibility of assembling parts, which are manufactured separately and can be standardized, both in view of semi products as well as the finalized ski as a whole.

A collapsible ski is also disclosed in U.S. Pat. No. 4,405,150. Such a ski in its functional state and when it is ready to use, like each functional ski, comprises a front area with a tip, which is smoothly bent away from the ground, a rear area at least approximately flat or smoothly bent away from the ground, as well as a central area which is provided for mounting of a ski binding. The surface facing the ground is furnished with a sliding surface, the lateral edges of which are equipped with ski edges serving as guides for a ski while turning on hard ground. Such a ski consists of at least three parts, which can be connected with each other in a detachable manner, namely a front part and a rear part, which can be interconnected in a detachable manner, as well as a top part which is pivotally interconnected with said rear part and can be placed over at least a portion of said front part and then fixed in this position, in which said parts are overlapped. Said top part is conceived as a U-profile and adjusted to cooperate with two ribs which are arranged on the top surface of said front part and said rear part at least in the central area in the area of the cooperation of said parts and which project from the ground. Those skilled in the art will understand that during bending of the ski, due to its sloped position said top part, in particular a free area thereof, is permanently exposed to forces which cause said top part to move away from the surface of the ski; this is why the top part must be firmly fixed, and the area of the fixation thereof is under heavy loads.

Although such a concept allows movements of said top part relative to said pivotally interconnected front part and rear part, said front part and rear part are essentially thickened in said area of cooperation with the top part, which considerably increases the stiffness of each of them. Such locally increased stiffness considerably changes the bending properties of the ski as such, since its bending capability in the front area and in the rear area considerably exceeds that in the central area.

Moreover, due to such a concept also the height, namely the distance between the sliding surface and the bottom surface of a ski shoe is essentially changed, which is desired when the ski is used by extremely skilled users, e.g. in ski competitions, which is, however, in contradiction with the concept of such a ski which is a priori not intended for such purposes.

Besides, the described concept of the top part in the form of a U-profile does not allow mounting of rails for a quick mounting of a ski binding. Adapting the top part to such purpose would result in an additional considerable increase in the height, weight and stiffness of the ski.

The invention relates to a collapsible ski, which, in its assembled i.e. functional state, comprises a front area with a tip which is smoothly bent in a direction away from the ground, a rear area with a tail, which is either at least approximately flat or smoothly bent away from the ground, as well as a central area, which is provided for mounting of a ski binding which consists of a front assembly and a rear assembly and is suitable for being attached to a ski shoe onto a top surface of the ski, which faces away from the ground while in use. The opposite surface of the ski, which, while in use, faces the ground, is furnished with ski edges which extend along at least the majority of the ski length. Such a ski furthermore consists of a front part and a rear part, which are connected with each other and can be pivoted around a first geometric axis which extends parallel to said sliding surface, and which parts, when aligned with each other, can be fixed in such a position by means of a platform which is provided for the attachment of a front assembly and a rear assembly of said ski binding.

The invention provides that said platform is interconnected with the front part of the ski in a non-detachable manner by means of a connecting plate which is mounted on the top surface of the ski and rotatable around a second geometric axis which extends perpendicularly with respect to said top surface of the ski. Said connecting plate and said platform are interconnected by means of hinges on the front area of the platform, which is located closely to the first part of the ski binding, such that the platform can be pivoted relatively to the connecting plate around a third geometric axis, which extends parallel to the top surface of the ski and can be, together with said connecting plate, pivoted around said second geometric axis. In its front area adjacent to the front assembly of the ski binding, said platform is furnished with a first tongue in the form of a circular arc, and in the rear area adjacent to the rear assembly of the ski binding with a second tongue also in the form of a circular arc.

At a distance from said geometric axis, around which the platform can be rotated, a first retaining protrusion is provided on the top surface of the front part of the ski, namely in a direction towards the ski tip, wherein said first retaining protrusion comprises a groove in the form of a circular arc, which is adapted to cooperate at least with the first tongue at the front end of said platform. Moreover, a second retaining protrusion is provided on the top surface of the ski, which is located at a distance from said first retaining protrusion in a direction towards the ski tip and is also furnished with a groove in the form of a circular arc, which is adapted to cooperate at least with the second tongue at the rear end of the platform. Still further, a third retaining protrusion is provided on the top surface of the rear part of the ski at a distance from the first geometric axis, around which said front part and said rear part of the ski can be pivoted, wherein said third retaining protrusion is furnished with a groove also in the form of a circular arc, which is adapted to cooperate at least with the second tongue at the rear end of the platform.

Said second retaining protrusion on the front part of the ski is optionally furnished with an arresting mechanism which is adapted to cooperate with a corresponding recess on the second tongue at the rear end of the platform, by which the latter is retained in each desired position on the top surface of the front part of the ski.

Analogously, said third retaining protrusion on the rear part of the ski is preferably furnished with an arresting mechanism which is adapted to cooperate with a corresponding recess on the first tongue on the rear end of the platform, by which the latter is retained in each desired position on the top surface of the rear part of the ski.

Moreover, it can be preferred in accordance with the invention, that said front part and said rear part of the ski are connected with each other with a possibility of being pivoted around the first geometric axis by means of at least two pairs of levers, which are in the transversal direction of the ski equidistantly arranged apart from each other, and each of them is pivotally interconnected on the one hand with the front part and on the other hand with the rear part of the ski.

The invention will be described on the basis of embodiments, which are shown in the attached drawings, wherein FIG. 1 is an isometric view of a collapsible ski according to the invention in its assembled i.e. functional state;

Figure 1:
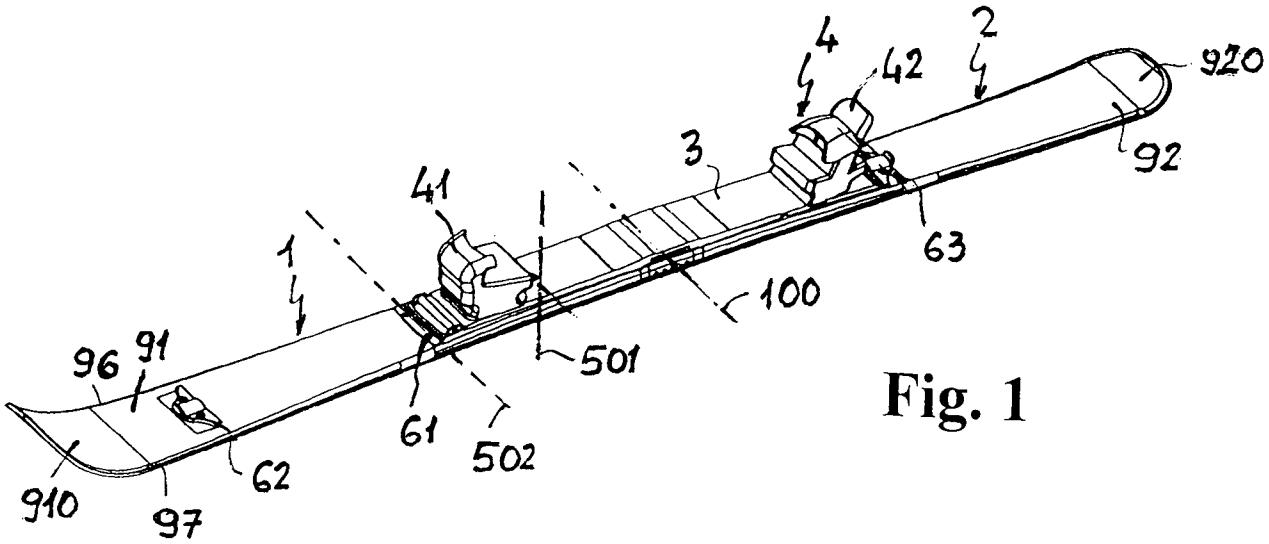
Figure 2:
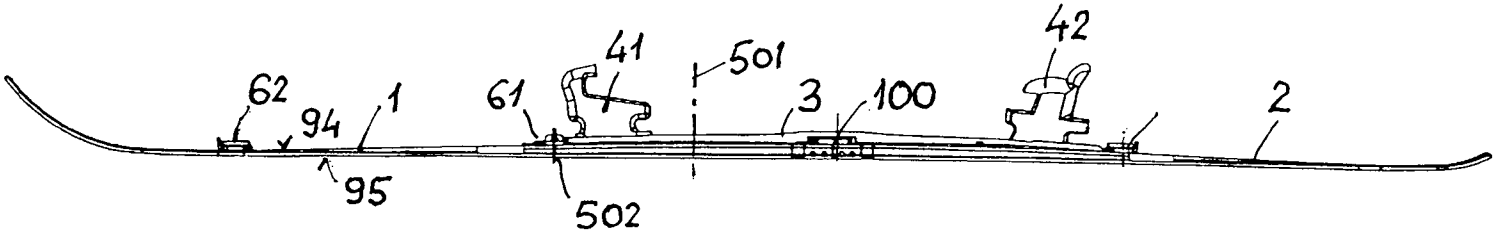
FIG. 2 is a front view of the ski according to FIG. 1.
Figure 9:
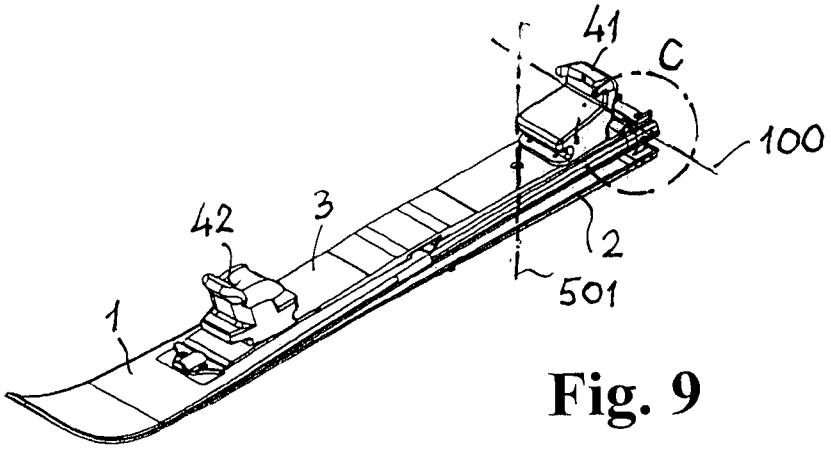
FIG. 9 is an isometric view of the ski according to the invention in its disassembled state, in which it is ready for storage or transport.
Figure 10:
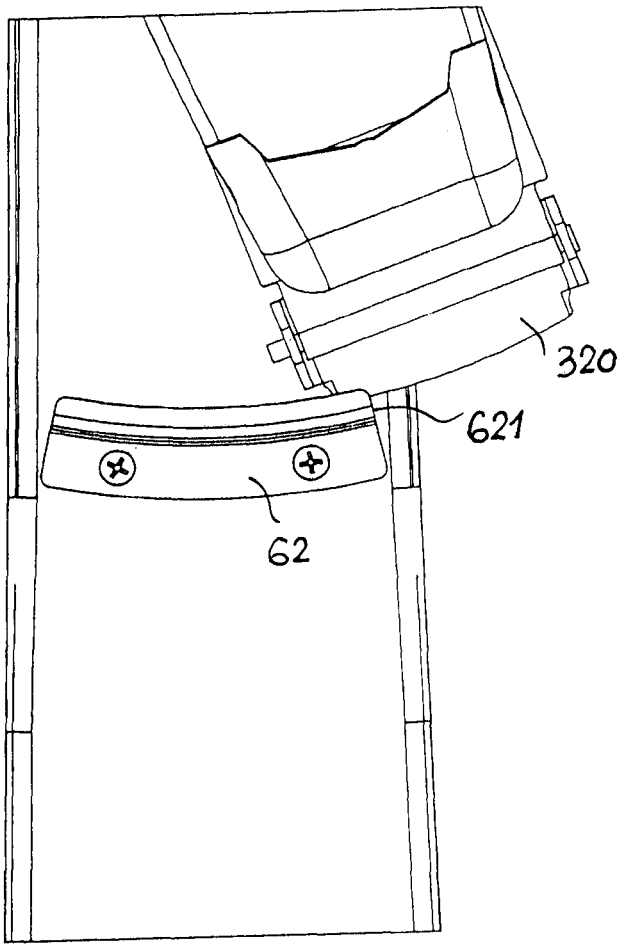
FIG. 10 is a symbolic isometric presentation of detail A according to FIG. 6.
Figure 11:
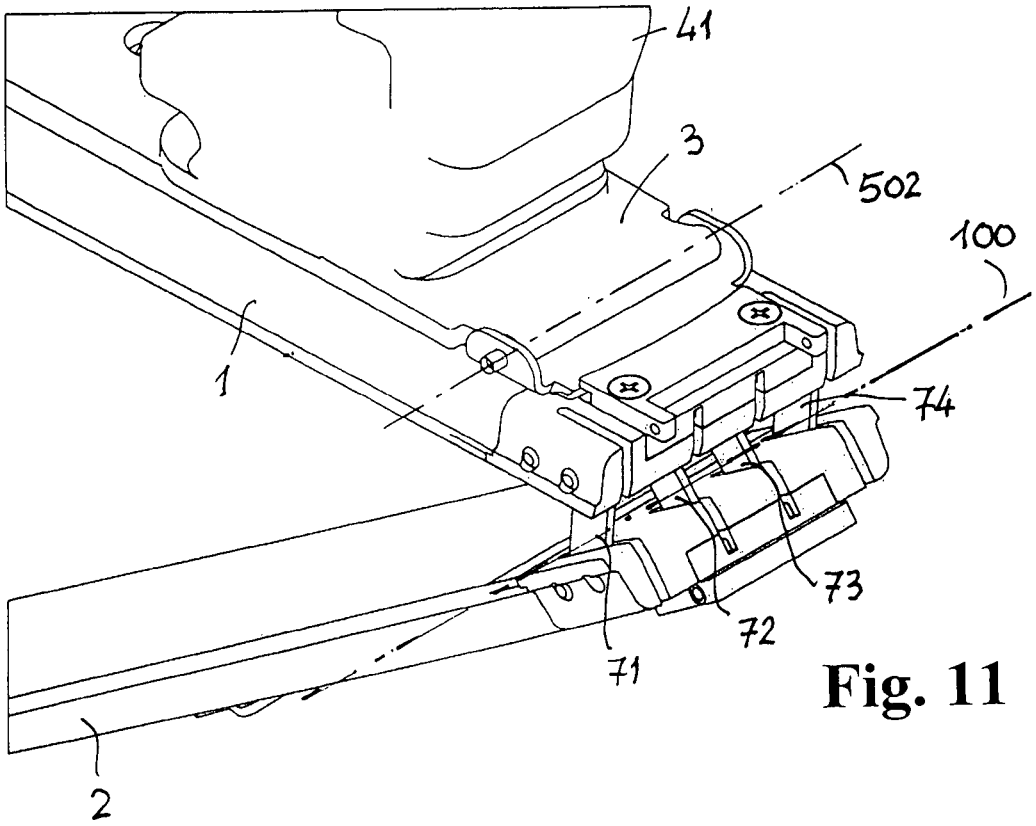
FIG. 11 is an isometric presentation of detail B according to FIG. 8.
Figure 12:
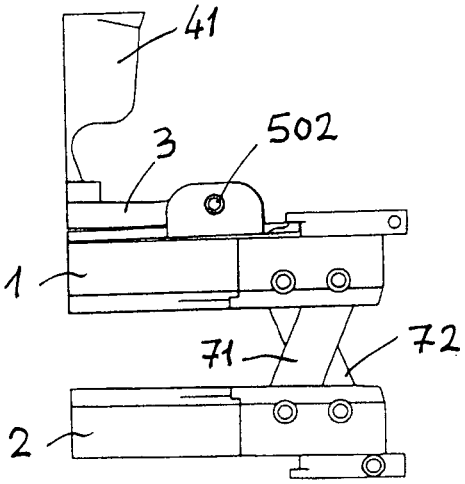
FIG. 12 is a front view of detail C according to FIG. 9.

FIGS. 1 and 2 present a collapsible ski in its assembled state, in which the ski is prepared for sliding on ground. Said ski is in its disassembled state, in which it is suitable for storage or transport in a rucksack e.g. while performing alpine or military activities, shown in FIG. 9.

Such a ski generally comprises a front area 91 with a tip 910 which is smoothly bent away from the ground, a rear area 92 with a tail 920, which is either at least approximately flat or smoothly bent away from the ground, as well as a central area, which is provided for mounting of a ski binding 4 which consists of a front assembly 41 and a rear assembly 42 and is suitable for attachment of each ski shoe onto a top surface 94 of the ski, which, while in use, faces away from the ground. The opposite surface 95 of the ski, which, while in use, faces the ground, is furnished with ski edges 96, 97.

Furthermore, such a ski consists of a front part 1 and a rear part 2, which are connected with each other in such a manner, that they can be pivoted relatively to each other around a first geometric axis 100 which extends parallel to the sliding surface 95 and are optionally in their aligned position fixed by means of a platform 3 which is provided for mounting of said front part 41 and said rear part 42 of the ski binding 4.

Said platform 3 is, by means of a connecting plate 5 which is fixed onto the top surface 94 of the ski and can be pivoted around a second geometric axis, 501 which extends perpendicularly relative to said top surface of the ski, interconnected with the front part 1 of the ski in a non-detachable manner.

Said connecting plate 5 and said platform 3 are optionally interconnected by means of hinges on the front area 31 of the platform 3, which is located closely to the first part 41 of the ski binding 4. In such a case, the platform 3 can be pivoted relatively to the connecting plate 5 around a third geometric axis 502 which extends parallel to the top surface 94 of the ski; and can be pivoted around said second geometric axis 501 together with said connecting plate 5.

Said platform 3 is—analogously like in the embodiment as disclosed in SI 24358 A—on its bottom surface 33, which faces the front part 1 and the rear part 2 of the ski, furnished with a centrally located cavity 35, in which two diametrically opposite recesses 351, 352 are provided, which are adapted to cooperate with first arresting protrusion 511 and second arresting protrusion 512 respectively, wherein the first arresting protrusion is arranged on the front part 1 and the second arresting protrusion is provided on the rear part 2 of the ski. Whenever the front part 1 and the rear part 2 are aligned and said platform 3 is rotated around the second geometric axis 501 at a certain angle said first and second arresting protrusions 511, 512 can enter said cavity 35 on the platform 3. After rotating of said platform around the vertical second geometric axis 501 into a position, in which the platform 3 is aligned with both parts 1, 2 of the ski, said first and second arresting protrusions are located within said recesses 351, 352 within said cavity 35 on the platform 3 (FIG. 1) so that the latter is firmly, but still in a detachable manner interconnected both with the front part 1 and the rear part 2 of the ski.

Besides, in its front area 31 adjacent to the front assembly 41 of the ski binding 4, the platform 3 is furnished with a first tongue 310 in the form of a circular arc, and in the rear area 32 adjacent to the rear assembly 42 of the ski binding 4 with a second tongue 320 also in the form of a circular arc.

On the other hand, the first retaining protrusion 61 is provided on the top surface 94 of the front part 1 of the ski, which is located at a distance from the second geometric axis 501, around which the platform can be rotated, namely in a direction towards the ski tip 910, said first retaining protrusion 61 comprising a groove 610 in the form of a part of a circular arc, which is adapted to cooperate at least with the first tongue 310 on the front area 31 of the platform.

Furthermore, the second retaining protrusion 62 is provided on the top surface 94 of the ski, which is located at a distance from said first retaining protrusion 61 in a direction towards the ski tip 910 and is also furnished with a groove 620 in the form of a circular arc, which is adapted to cooperate at least with the second tongue 320 on the rear area 32 of the platform 3.

Moreover, the third retaining protrusion 63 is provided on the top surface of the rear part 2 of the ski at a distance from the first geometric axis 100, around which said front part 1 and said rear part 2 of the ski can be pivoted, wherein said third retaining protrusion is furnished with a groove 630 also in the form of a circular arc, which is adapted to cooperate at least with second tongue 320 on the rear area 32 of the platform 3.

Said second retaining protrusion 62 on the front part 1 of the ski is preferably furnished with an arresting mechanism 621 which is adapted to cooperate with a corresponding recess 321 on the second tongue 320 on the rear area 32 of the platform 3, by which the latter is retained in each desired position on the top surface 94 of the front part 1 of the ski.

Also said third retaining protrusion 63 on the rear part 2 of the ski is preferably furnished with an arresting mechanism 631 which is adapted to cooperate with the corresponding recess 321 on the second tongue 320 on the rear area 32 of the platform 3, by which the latter is retained in each desired position on the top surface 94 of the rear part 2 of the ski.

Still further, in the shown embodiment, said front part 1 and said rear part 2 of the ski are connected with each other with a possibility of being pivoted around the first geometric axis 100 by means of at least two pairs of levers 71, 72, 73, 74, which are in the transversal direction of the ski equidistantly arranged, and each of them is pivotally interconnected on the one hand with the front part 1 and on the other hand with the rear part 2 of the ski.

When the ski is in use, the first tongue 310 on the front area of the platform 3 is located within the groove 610 on the first retaining protrusion, while the second tongue 320 on the rear area of the platform 3 is located within the groove 630 on the third retaining protrusion, in which it is preferably arrested by means of the arresting mechanism 631, by which on the one hand both parts 1, 2 of the ski are firmly interconnected and on the other hand each rotation of the platform is prevented.

Figure 3:
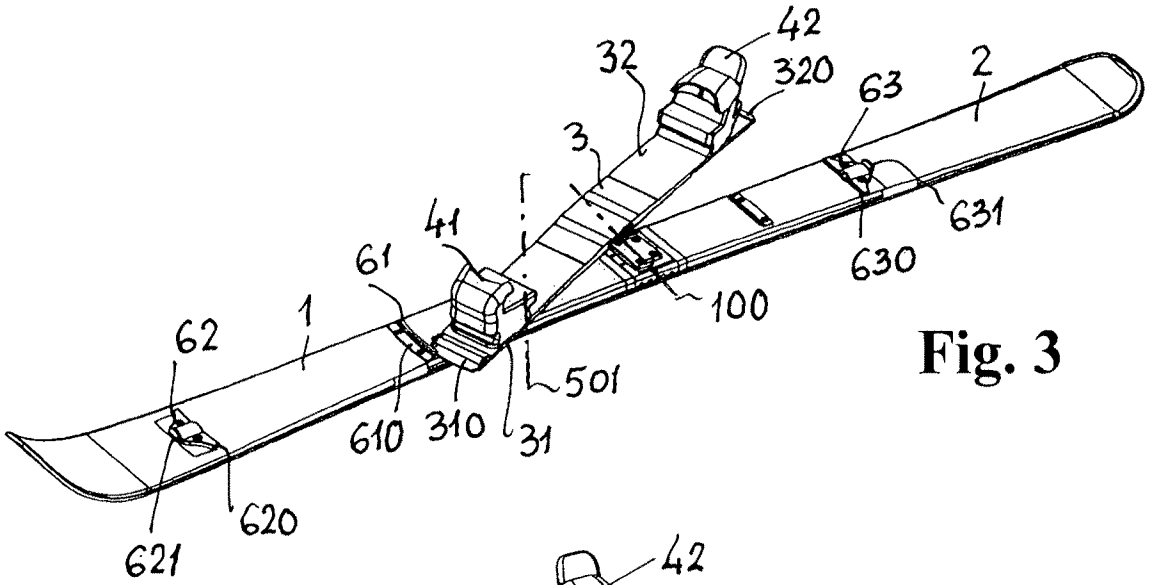
FIG. 3 is an isometric view of the ski according to FIGS. 1 and 2 during disassembling.
Figure 4:
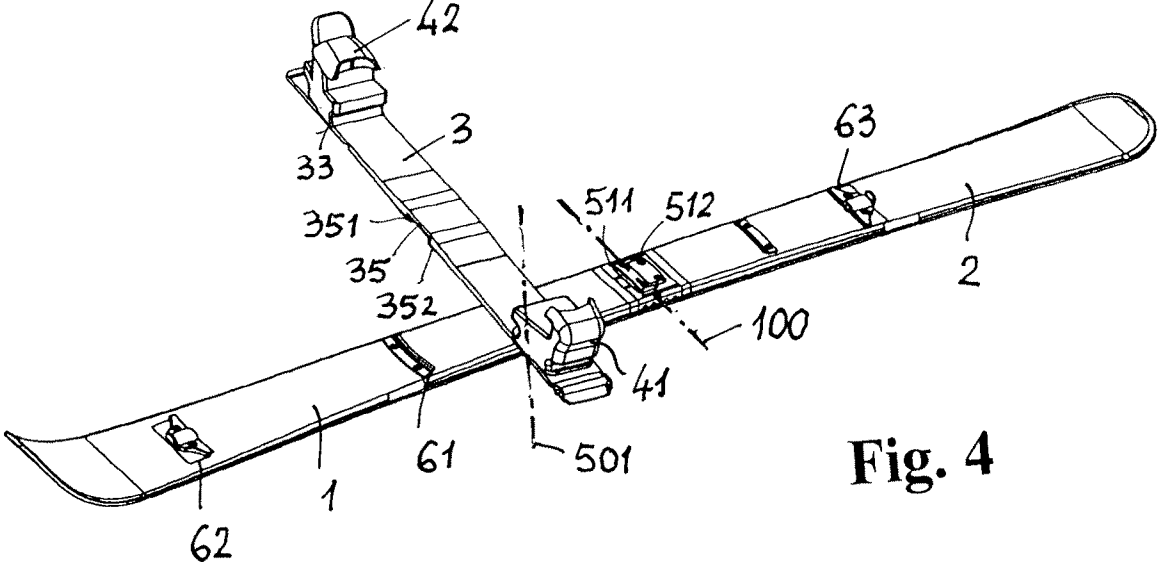
FIG. 4 is an isometric view of the ski according to FIGS. 1 and 2, also during disassembling.
Figure 5:
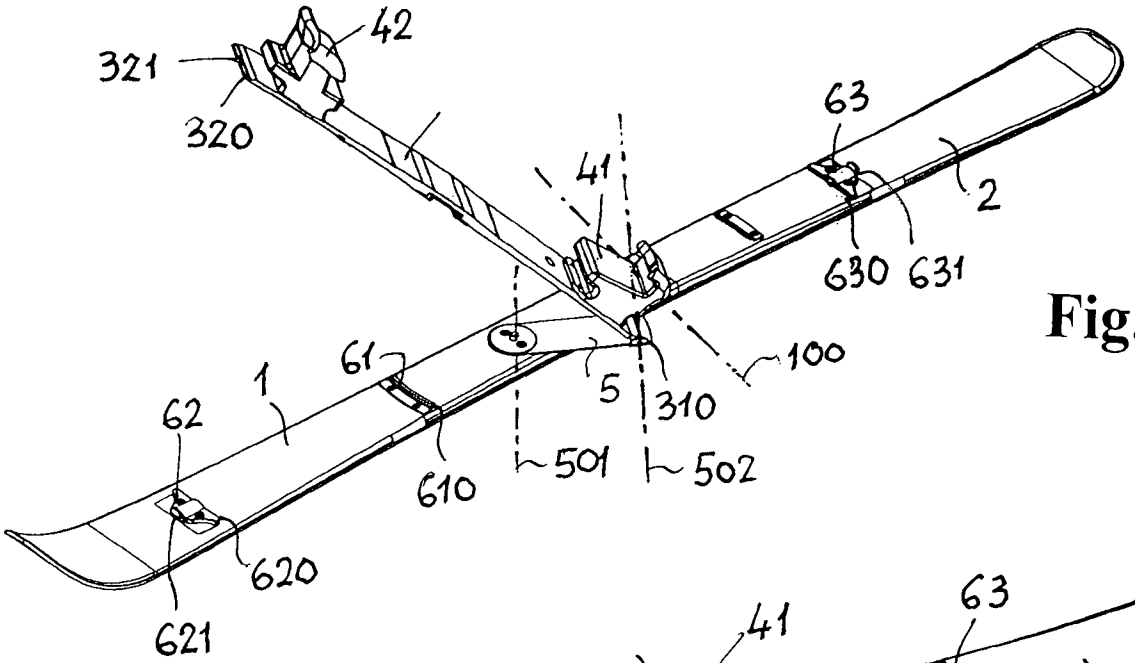
FIG. 5 is an isometric view of the ski according to FIGS. 1 and 2, also during disassembling.
Figure 6:
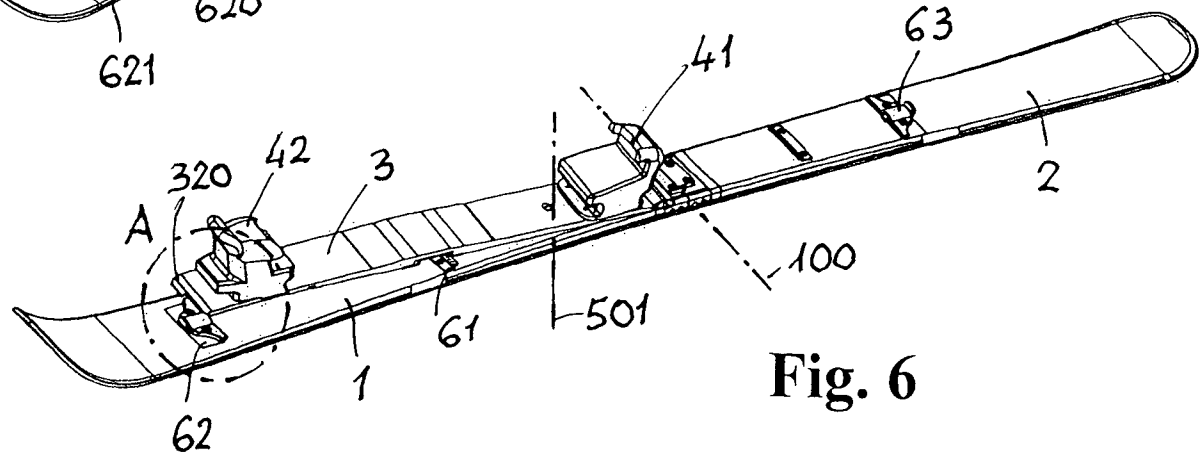
FIG. 6 is an isometric view of the ski according to FIGS. 1 and 2, also during disassembling.
Figure 7:
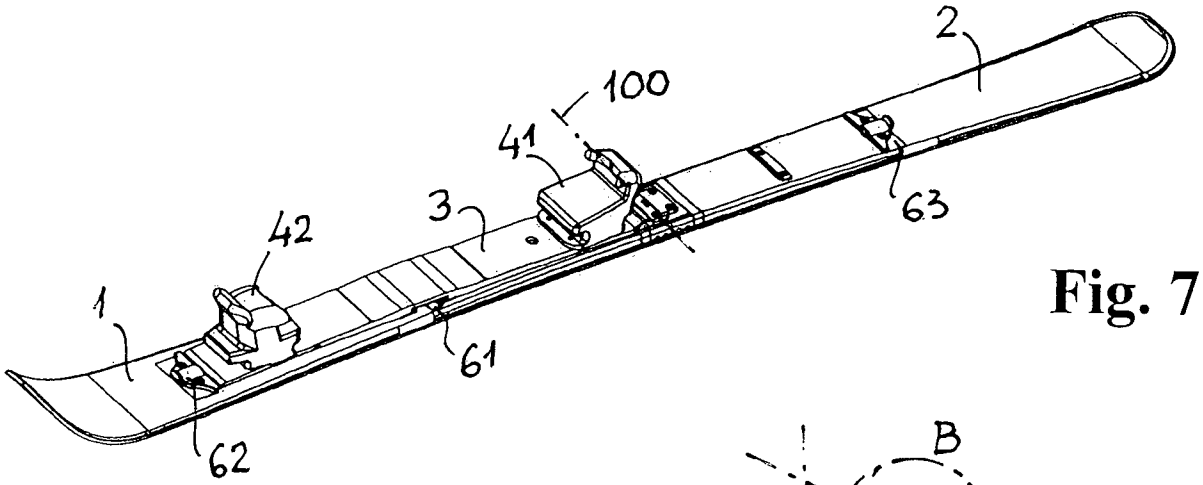
FIG. 7 is an isometric view of the ski according to FIGS. 1 and 2, also during disassembling.
Figure 8:
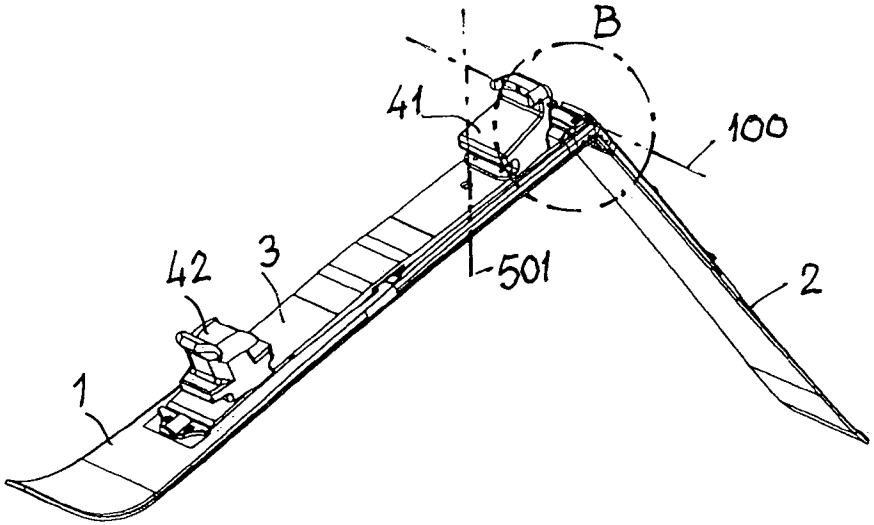
FIG. 8 is an isometric view of the ski according to FIGS. 1 and 2, also during disassembling.

After said mechanism 631 is deactivated, the platform 3 is allowed to rotate around said second geometric axis 501 (FIG. 3), by which the first and second tongues 310, 320 are released from said grooves 610, 630. Upon rotating the connecting plate 5 together with the platform 3 around the second geometric axis 501 by 180°, the second tongue 320 on the rear area 32 of the platform 3 enters the groove of the second retaining protrusion 62 on the side of the tip 910 on the front part 1 of the ski, by which said firm interconnection of both parts 1, 2 of the ski is released, however they still remain connected with each other by means of the hinges in the area of the first geometric axis 100. The platform 3 rests on the top surface 94 of the front part 1 of the ski and remains interconnected therewith, while the rear part 2 of the ski can be pivoted and displaced closely to the front part 1, by which the ski is disassembled and ready for transport.

The invention claimed is:

1. A collapsible ski comprising a front area with a tip, which is smoothly bent in a direction away from the ground, a rear area with a tail, which is either at least approximately flat or smoothly bent away from the ground, a central area for mounting of a ski binding which includes a front assembly and a rear assembly and is suitable for attachment of each ski shoe onto a top surface of the ski, which, while in use, faces away from the ground while the opposite sliding surface of the collapsible ski, which, while in use, faces the ground, is furnished with ski edges; which extend along at least a majority of the ski length, and wherein the collapsible ski includes a front part and a rear part, which are connected with each other and pivoted around a first geometric axis which extends parallel to said sliding surface, and which parts, when aligned, are fixed in such a position by a platform which is provided for attachment of the front assembly and the rear assembly of said ski binding, and wherein said platform is, on a bottom surface facing said front part and rear part of the ski, furnished with a centrally located cavity, in which two diametrically spaced recesses are arranged, which are adapted to cooperate with first and second arresting protrusions, of which the first arresting protrusion is provided on the front part, and the second arresting protrusion on the rear part of the ski, said platform being interconnected with the front part of the collapsible ski in a non-detachable manner by a connecting plate which is mounted on the top surface of the ski and rotatable around a second geometric axis which extends perpendicularly with respect to said top surface of the ski, said platform being in a front area adjacent to the front assembly of the ski binding furnished with a first tongue in a form of a circular arc, and in the rear area of the platform adjacent to the rear assembly of the ski binding with a second tongue in a form of a circular arc, wherein a first retaining protrusion is provided on the top surface of the front part of the ski, which is located at a distance from said second geometric axis, around which the platform is rotated, in a direction towards the ski tip, wherein said first retaining protrusion includes a groove in a form of a circular arc, which is adapted to cooperate at least with the first tongue on the front area of said platform, while a second retaining protrusion is provided on the top surface of the collapsible ski, which is located at a distance from said first retaining protrusion in a direction towards the ski tip and furnished with a groove in a form of a circular arc, which is adapted to cooperate at least with the second tongue on the rear area of the platform, and, a third retaining protrusion is provided on the top surface of the rear part of the collapsible ski at a distance from the first geometric axis, around which said front part and said rear part of the ski are pivoted, wherein said third retaining protrusion is furnished with a groove in a form of a circular arc, which is adapted to cooperate at least with the second tongue on the rear area of the platform.

2. The collapsible ski according to claim 1, wherein said connecting plate and said platform are interconnected by hinges on the front area of the platform, which is located close to the front assembly of the ski binding, such that the platform is pivoted relatively to the connecting plate around a third geometric axis which extends parallel to the top surface of the ski, and is together with said connecting plate pivoted around the second geometric axis.

3. The collapsible ski according to claim 1, wherein said second retaining protrusion on the front part of the collapsible ski is furnished with an arresting mechanism which is adapted to cooperate with a corresponding recess on the second tongue on the rear area of the platform, by which the platform is retained in a position on the top surface of the front part of the collapsible ski.

4. The collapsible ski according to claim 1, wherein said third retaining protrusion on the rear part of the collapsible ski is furnished with an arresting mechanism which is adapted to cooperate with a corresponding recess on the second tongue on the rear area of the platform, by which the platform is retained in a position on the top surface of the rear part of the collapsible ski.

5. The collapsible ski according to claim 1, wherein said front part and said rear part of the collapsible ski are connected with each other with a possibility of being pivoted around the first geometric axis by at least two pairs of levers, which are in a transversal direction of the collapsible ski equidistantly arranged, and each of them is pivotally interconnected on the one hand with the front part and on the other hand with the rear part of the ski.

* * * * *